US009336643B2

(12) United States Patent
Witty et al.

(10) Patent No.: US 9,336,643 B2
(45) Date of Patent: May 10, 2016

(54) LIVE TABLE GAMING AND AUXILIARY MYSTERY PROGRESSIVE JACKPOTS

(75) Inventors: Simon McLaren Witty, Mosman (AU); Harley David Jackson, Collaroy Plateau (AU)

(73) Assignee: TCS JOHN HUXLEY AUSTRALIA PTY LIMITED, Artarmon (AU)

( * ) Notice: Subject to any disclaimer, the term of this patent is extended or adjusted under 35 U.S.C. 154(b) by 37 days.

(21) Appl. No.: 13/981,511

(22) PCT Filed: Jan. 23, 2012

(86) PCT No.: PCT/AU2012/000042

§ 371 (c)(1),
(2), (4) Date: Jul. 24, 2013

(87) PCT Pub. No.: WO2012/100286

PCT Pub. Date: Aug. 2, 2012

(65) Prior Publication Data

US 2013/0310165 A1 Nov. 21, 2013

(30) Foreign Application Priority Data

Jan. 24, 2011 (AU) ..... 2011900208

(51) Int. Cl.
*G07F 17/32* (2006.01)

(52) U.S. Cl.
CPC ..... *G07F 17/32* (2013.01); *G07F 17/322* (2013.01); *G07F 17/3244* (2013.01); *G07F 17/3258* (2013.01)

(58) Field of Classification Search
CPC . G07F 17/32; G07F 17/3258; G07F 17/3244; G07F 17/322; G07F 17/3293
See application file for complete search history.

(56) References Cited

U.S. PATENT DOCUMENTS

| | | | | |
|---|---|---|---|---|
| 5,377,973 | A * | 1/1995 | Jones et al. | 463/12 |
| 2003/0064798 | A1* | 4/2003 | Grauzer et al. | 463/29 |
| 2005/0215313 | A1* | 9/2005 | O'Halloran | 463/26 |
| 2005/0239542 | A1* | 10/2005 | Olsen | G07F 17/32 463/27 |
| 2007/0060318 | A1* | 3/2007 | O'Halloran et al. | 463/26 |
| 2008/0099993 | A1* | 5/2008 | Araico Cao | G07F 17/3258 273/274 |

OTHER PUBLICATIONS

International Search Report and Written Opinion of the International Searching Authority for International Patent Application No. PCT/AU2012/000042 mailed Apr. 4, 2012.

* cited by examiner

*Primary Examiner* — Jay Liddle
*Assistant Examiner* — Alex F. R. P. Rada, II
(74) *Attorney, Agent, or Firm* — Lowenstein Sandler LLP

(57) ABSTRACT

The invention provides a method for playing an auxiliary progressive jackpot game associated with a base, live casino table game. The invention extends to an apparatus for administering the auxiliary game and notifying players of game occurrences including jackpot winners.

17 Claims, 5 Drawing Sheets

Fig. 6
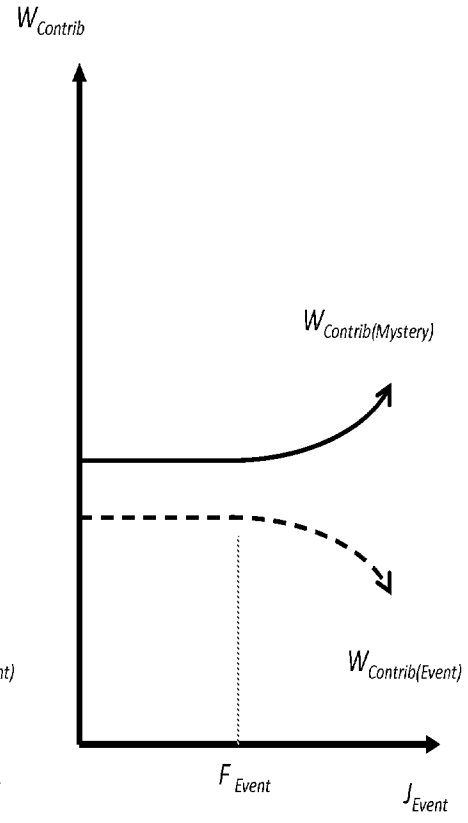
Fig. 7
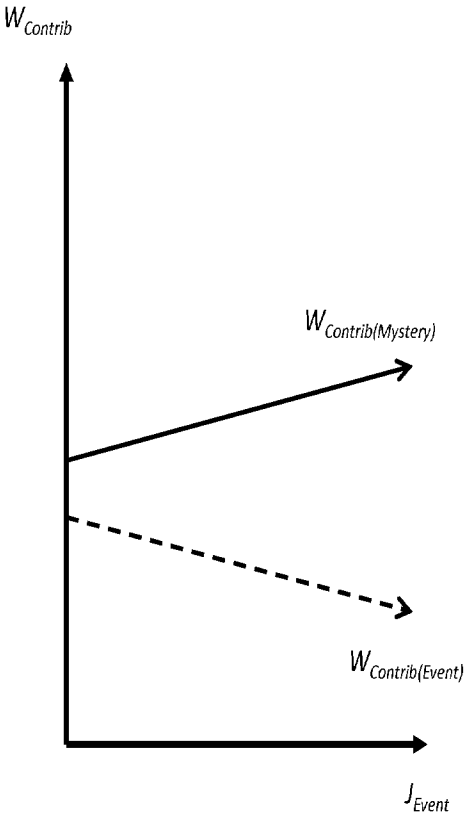
Fig. 8

LIVE TABLE GAMING AND AUXILIARY MYSTERY PROGRESSIVE JACKPOTS

FIELD OF THE INVENTION

The present invention relates generally to live table games and more particularly to providing bonus jackpot prizes to enhance existing card and table games in gaming establishments.

BACKGROUND OF THE INVENTION

The following discussion of the prior art is intended to facilitate an understanding of the invention and to enable the advantages of it to be more fully understood. It should be appreciated, however, that any reference to prior art throughout the specification should not be construed as an express or implied admission that such prior art is widely known or forms part of common general knowledge in the field.

It is now common for gaming establishments to offer jackpot prizes on casino table games. During the course of play of a base casino table game, players are provided the option of entering an auxiliary game by placing a side wager. A portion of the side wager accumulates a prize pool which is won when a participating player receives a predetermined game outcome in the base game. This type of side wager and jackpot are known as the "event based progressive" jackpot because the jackpot accumulates as more players elect to make a side wager and because it is won depending on particular events occurring in the base game.

Examples of such games are Caribbean Stud Poker as described in U.S. Pat. No. 6,073,930 and Texas Hold 'Em Poker. The method of play of these games involves the player opting to place an optional additional side wager in anticipation of being dealt a particular hand, for instance a Royal Flush, in the base game. The side wagers taken from all participating players on the table and across a number of tables contribute to a jackpot prize pool. If a player is dealt the winning hand, the player wins 100% of the accumulated prize pool.

Depending on the number of gaming tables contributing to the prize pool and the game configuration, these prize pools can quickly grow to more than 100,000 times the base side wager. The attraction of these games is the chance to win a significant prize. Different configurations can be setup to award different percentages of the prize pool however the games are common in that a pre determined hand is awarded a percentage of the prize pool.

One down side of these games is that the likelihood of winning the main prize is very low and consequently interest in the game wanes.

Gaming suppliers and gaming establishments are always looking at new base games on which to offer a standard progressive to renew interest however an event based progressive has an inherent trade off—a large prize is popular initially but in order for the prize pool to accumulate to a high value its frequency of a win occurrence must be very low and over time players will lose interest.

Another method of providing jackpots and bonus prizes on table games is the random progressive type jackpot auxiliary game which commonly involves an event generated by a Random Number Generator ("RNG") which is associated in some way with the underlying casino game. As an example a display can show a randomly generated lucky card during the sequence of play of an underlying base game. If the random card is matched by the same card in a player's hand, then that player is awarded a prize. Such a method is described in U.S. Pat. No. 5,743,800.

One problem with this game is that it can be difficult to expand the side game across different types of table games because the chance of winning the jackpot can depend upon fixed odds in the base game.

It is an object of the present invention to overcome or substantially ameliorate one or more of the deficiencies of the prior art, or at least to provide a useful alternative.

SUMMARY OF THE INVENTION

Accordingly, in a first aspect the invention provides a computer implemented method of playing an auxiliary mystery progressive jackpot game during play of an associated live casino base table game, wherein the base game is played by a plurality of base game players, the method including the steps of:

establishing a first mystery progressive jackpot game;

providing each base game player with respective side wager registration device and player indicator each operatively linked to a table controller;

providing each base game player with the option to become a participating player in the auxiliary game by registering a respective side wager with the wager registration device;

accepting the side wagers from each participating player;

allocating a first portion of each accepted side wager to accumulate a first accumulated mystery progressive jackpot prize pool associated with the first game;

selecting a winning player of the first game from participating players based on a first random event unrelated to the base game;

notifying the players of the winning player of the first game by coordinated activation of the player indicators in a display sequence.

Preferably, the step of establishing a first game includes the further steps of:

providing a game computer having a microprocessor and memory device;

predetermining and storing in the memory device a first mystery jackpot range between a first lower jackpot limit ($J_{Lower}$) and a first upper jackpot limit ($J_{Upper}$);

predetermining and storing in the memory device a side wager value ($W_{Entry}$) for participating in the auxiliary game; and predetermining and storing in the memory device a first mystery jackpot contribution portion ($W_{Contrib}$) of the side wager value ($W_{Entry}$) to accumulate the first mystery jackpot prize pool; and storing in the memory device a first mystery jackpot prize pool value ($J_{Current}$) representing the accumulated mystery progressive jackpot prize pool.

Preferably, the step of establishing a first game further includes the step of generating and storing a random number representing a first secret first mystery jackpot win value ($J_{Win}$) within the first jackpot range and storing the first secret win value in the game computer memory; and wherein the step of selecting a winning player of the first game includes the further steps of:

consecutively processing each side wager of participating players with the game computer by the steps of:

calculating a new first mystery jackpot prize pool by incrementing the stored first mystery jackpot prize pool value ($J_{Current}$) by the first mystery jackpot contribution portion ($W_{Contrib}$);

storing the new first jackpot prize pool value as the first mystery jackpot prize pool value ($J_{Current}$);

when the first mystery jackpot prize pool value is equal to or greater than the secret first mystery jackpot win value:

nominating the respective player as a winning player of the first game;

saving the first mystery jackpot prize pool value ($J_{Current}$) as the first mystery jackpot prize value; and storing one of the first jackpot limits as the first mystery jackpot prize pool value ($J_{Current}$).

Preferably, the step of selecting a winning player of the first game includes the further steps of:

consecutively processing each side wager of participating players with the game computer by the steps of:

determining the probability that the respective player will be a winning player in view of the first mystery jackpot prize pool value ($J_{Current}$), the first mystery jackpot contribution portion ($W_{Contrib}$) of the side wager value ($W_{Entry}$) and the first jackpot limits ($J_{Lower}$ and $J_{Upper}$);

generating and storing a random number representing a first random probability;

calculating a new first mystery jackpot prize pool by incrementing the stored first mystery jackpot prize pool value ($J_{Current}$) by the first mystery jackpot contribution portion ($W_{Contrib}$);

storing the new first jackpot prize pool value as the first mystery jackpot prize pool value ($J_{Current}$);

where first random probability is less than the probability that the respective player will be a winning player:

nominating the respective player as a winning player of the first game;

saving the first mystery jackpot prize pool value ($J_{Current}$) as the first mystery jackpot prize value; and storing one of the first jackpot limits as the first mystery jackpot prize pool value ($J_{Current}$).

Preferably, the step of generating and storing a random number is performed with a Random Number Generator.

Preferably, the step of notifying the players of the winning player includes the further steps of:

providing an initial display sequence of coordinated activation of the players indicators; and providing a final display sequence whereby the respective player indicator of any winning player of the first game is distinguishable from that of other indicators at the table.

Preferably, the auxiliary game players are located at one or more base game tables.

Preferably, the auxiliary game includes:

establishing a second mystery progressive jackpot game;

allocating a second portion of each accepted side wager to accumulate a second accumulated mystery progressive jackpot prize pool associated with the second game;

selecting a winning player of the second game from participating players based on a second random event unrelated to the base game;

notifying the players of the winning player by coordinated activation of the player indicators in a display sequence.

Preferably, the auxiliary game includes:

establishing an event based progressive jackpot game;

allocating a portion of each accepted side wager to accumulate a accumulated event progressive jackpot prize pool associated with the event game;

selecting a winning player of the second game from participating players based on a predetermined event occurrence in the base game; and awarding the accumulated event progressive jackpot prize pool associated with the event progressive jackpot to any winning player of the second game.

Preferably, the base game is played by a plurality of base game players, the method including the steps of:

establishing a mystery progressive jackpot;

establishing an event based progressive jackpot;

providing each base game player with respective side wager registration device and player indicator;

providing each base game player with the option to participate in the auxiliary game by registering a respective side wager of a predetermined side wager value with the wager registration device;

accepting the side wagers from each player electing to participate in the auxiliary game;

allocating a first portion of each accepted side wager to accumulate a first accumulated mystery progressive jackpot prize pool ($J_{Current}$) associated with the first mystery progressive jackpot;

determining whether each participating player has won the first mystery progressive jackpot prize pool based on a random event non-related to the base game;

notifying the players whether a participating player has won the first mystery jackpot prize pool by coordinated activation of the player indicators.

Preferably, the method further including the step of providing betting chips for registering a side wager with the wager registration device.

Preferably, the wager registration device includes a receiving location for receiving a betting chip and a sensor for sensing the presence of a betting chip at the receiving location thereby for indication a player is making a side wager.

Preferably, each the player's indicator includes a visual display screen.

Preferably, an upper surface of each the player's indicator forms the receiving location of a respective player's side registration device.

Preferably, the option to participate in the auxiliary game is provided during a wager registration period.

Preferably, each the betting chip is visually identifiably as corresponding to a predetermined betting value.

Preferably, each the betting chip is visually identifiably as corresponding to any one of a plurality of predetermined betting values.

Preferably, during the wager registration period each the display screen visually displays a pattern corresponding to a betting chip value corresponding to the side wager value.

Preferably, the side wager value is variable.

Accordingly, in a another aspect the invention provides a system for administering play and awarding prizes in an auxiliary game during play of an associated base live casino table game, wherein the base game is played by at least one base game player, overseen by a dealer, and the auxiliary game includes a first mystery progressive jackpot game, the system including:

a gaming table including:

a plurality of player positions each for accommodating a respective base game player and wherein each player position includes a respective player's console having;

a player's indicator for displaying auxiliary game related data; and a side wager registration device for sensing whether a side wager has been registered at a respective player's console and generating a confirmation signal indicative of whether a respective player is a participating player in the auxiliary game; and a dealer's position for accommodating the dealer, the dealer's position having a dealer's console; and a game computer including;

a random number generator for generating random number data as a basis for determination of a winning player of the first mystery progressive jackpot game among participating players, the determination unrelated to the base game; and a controller for coordinating activation of the player's indicators in a predetermined display sequence thereby notifying the players of the winning player.

Preferably, the system includes memory for recording data indicative of predetermined first mystery progressive jackpot parameters, the parameters including:

a first mystery jackpot range between a first lower jackpot limit ($J_{Lower}$) and a first upper jackpot limit ($J_{Upper}$);

a current mystery progressive jackpot prize pool value ($J_{Current}$);

a side wager value ($W_{Entry}$) for participating in the auxiliary game; and a first mystery jackpot contribution portion ($W_{Contrib}$) of the side wager value ($W_{Entry}$) to accumulate the first mystery jackpot prize pool ($J_{Current}$) within the first mystery jackpot range.

Preferably, the game computer includes a second mystery progressive jackpot game and memory for recording data indicative of predetermined second mystery progressive jackpot parameters, the parameters including:

a second mystery jackpot range between a second lower jackpot limit ($J_{Lower}$) and a second upper jackpot limit ($J_{Upper}$);

a current second mystery progressive jackpot prize pool value ($J_{Current}$);

a side wager value ($W_{Entry}$) for participating in the auxiliary game; and a second mystery jackpot contribution portion ($W_{Contrib}$) of the side wager value ($W_{Entry}$) to accumulate the second mystery jackpot prize pool ($J_{Current}$) within the ($W_{Entry}$) second mystery jackpot range.

Preferably, the game computer includes a event progressive jackpot game and memory for recording data indicative of predetermined event progressive jackpot parameters.

In another aspect the invention provides a gaming environment having at least one gaming table for the playing of initial games of chance or skill, a method of increasing player incentives for interacting and betting, the method comprising the steps of:

(a) providing a first side wager game having bets contributing towards a gaming table winning event; and (b) providing a second side wager game having bets contributing towards a random jackpot winning event.

Preferably, a variable portion of the bets contributing towards the random jackpot winning event are contributed towards the gaming table winning event Preferably, the variable portion is increased in accordance with the size of the jackpot.

Preferably, the variable portion is only increased when the jackpot winning event exceeds a predetermined size.

Preferably, the gaming table has a series of player stations, with each player station having a visual playing state indicator, the method further including the steps of utilising the player state indicator to indicate player state conditions including at least one of betting phase on an initial game;

betting phase on a first or second side wager game;

betting phase locked; or a winning event on the first or second side wager game.

Preferably, the player state conditions includes a winning event and the visual playing state indicators for multiple player stations are activated in a temporally co-ordinated manner to produce a combined visual effect.

Preferably, the combined visual effect includes one of sparkling, pulsing, spinning, and flashing.

Preferably, each player station further includes a monitoring device for monitoring betting tokens for utilisation in bets.

In another aspect the invention provides a gaming system including:

a gaming table having a series of player stations, with each player station having a visual state indicator for indicating player state conditions;

a processing unit interconnected to and controlling the visual state indicators;

a controller unit interface interconnected to the processor for controlling operations on the gaming table;

the processing unit implementing a gaming environment providing a first side wager game having bets contributing towards a gambling table winning events and a second side wager game having bets contributing towards a random jackpot winning event.

Preferably, the gaming system further includes:

a display unit interconnected to the processing unit, visually discernable from the gaming table and indicating a magnitude of payout for the gambling table winning event and the random jackpot winning event.

Unless the context clearly requires otherwise, throughout the description and the claims, the words "comprise", "comprising", and the like are intended to be construed in an inclusive sense as opposed to an exclusive or exhaustive sense; that is to say, in the sense of "including, but not limited to".

BRIEF DESCRIPTION OF THE DRAWINGS

Preferred embodiments of the invention will now be described, by way of example only, with reference to the accompanying drawings in which:

FIGS. 6 to 8 are graphical representations of mode betting and allocation of the players side bet contribution towards each jackpot.

PREFERRED EMBODIMENTS OF THE INVENTION

Figure 1:
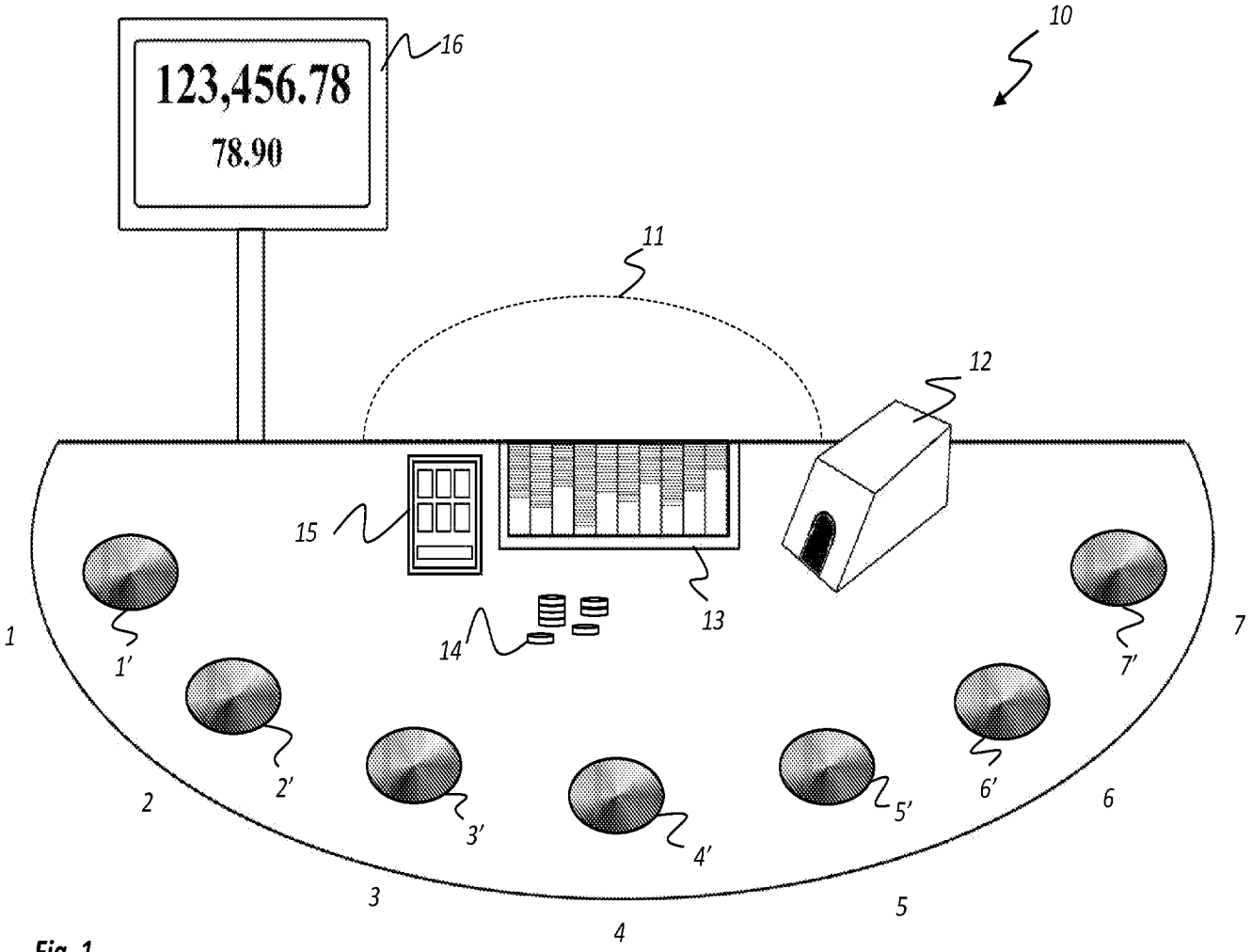
FIG. 1 is a schematic view of a gaming table in accordance with the invention.

The invention provides a method for playing an auxiliary progressive jackpot game associated with a base, live casino table game. The invention extends to an apparatus for administering the auxiliary game and notifying players of game occurrences including jackpot winners.

The auxiliary game is designed to be played as a supplementary betting game in conjunction with the base, live casino table game. The terms "table game", "casino table game", and "live casino table game" used herein is used to distinguish games of chance that are played by live players and administered by one or more live dealers such as a croupier or poker dealer, wherein the players and dealer/s are in close proximity to allow physical interaction. The term does not include games played solely on a mechanical and/or electronic device like a video slot machines, or internet and online games of chance. Such table games include, but are not limited to card games such as blackjack, poker or baccarat and extend to table games not involving cards such as roulette or craps. Table games usually include defined passages of play known as "rounds", "spins" or "hands" which break play into discrete portions.

The general method of play is as follows—at predetermined periods during the base table game, the base game players are provided the option of participating in the auxiliary game. The option is normally provided during the initial stages of each hand or round and normally only once per hand or round. Players electing to participate in the auxiliary game register their side wager with side wager registration means. The side wager corresponds to a predetermined value, and a predetermined portion of the wagered value is allocated towards at least one progressive jackpot prize pool. Each side wager increments the jackpot by the predetermined portion thereby increasing the size of the jackpot. Another house portion of each side wager may be directed toward the establishment (known as the house), while another establishment portion is often used to establish the jackpot or jackpots at an initial level following a win payout or when initiating the jackpot system.

The invention proposes a method of selecting a winner from the auxiliary game participating players which is randomly generated and independent of the base table game. This type of game is referred to as a mystery progressive type jackpot auxiliary game. In winning comparison to an event-based progressive jackpot, and even the random progressive type jackpot auxiliary game, the players are not directly involved in the identification of whether they have won. Accordingly, whether the player has won the jackpot prize may be kept secret from the players and revealed at a time and in a manner to create maximum suspense and effect. In addition, because the event is not based on the base game probabilities, the same jackpot pool may be configured across different types of base games.

One method of selecting a winner proposed by the invention is to use a Random Number Generator ("RNG") to randomly determine the winning event. For instance an RNG is used to select a mystery win value which is kept secret and stored. Preferably the mystery win value is selected within a predetermined range limited by at least an upper boundary but more preferably limited by upper and lower boundaries. The jackpot prize is initiated at the lower boundary and incremented sequentially by a predetermined portion of each side wager made. The jackpot is won by the player who's side wager increments the prize pool to equal or exceed the mystery win value. Alternatively, the jackpot may initiate at the upper limit and the jackpot prize incremented downwardly towards the lower limit. This type of jackpot maybe known as a mystery regressive rather than mystery progressive however the general concept is the same and the term "progressive" is intended as applying to either method or a combination of both.

One exemplary implementation of the invention will now be described in detail in which an auxiliary game is offered comprising a mystery progressive jackpot.

Commonly the base table game will be played at a gaming table including a dealer station for accommodating at least one dealer and a plurality of player stations for accommodating a plurality of players.

In this respect, referring to the FIG. 1 the apparatus includes a table 10 for playing a base casino game including a dealer station 11 and a plurality of player positions, 1-7. The dealer station 11 includes equipment required for playing the base table game such as a card shoe 12 housing playing cards however as noted, these components will depend on the base game so may vary.

In this embodiment of the invention, betting chips or tokens are used as a table currency for wagering bets. As such, the dealer station also includes a betting token tray 13 and a plurality of betting chips 14. The betting chips may correspond to and be redeemable for predetermined values including but not necessarily limited to currency values. Different types of chips may also correspond to different set amounts each type of chip readily distinguishable from one another. A dealer's interface console 15 is provided for exchanging information between the dealer and various components of the table while a jackpot display 16 is provided for displaying information regarding the jackpot status to the players.

Each player position 1-7 includes a corresponding players console 1'-7' situated adjacent a respective player's position.

Figure 2:
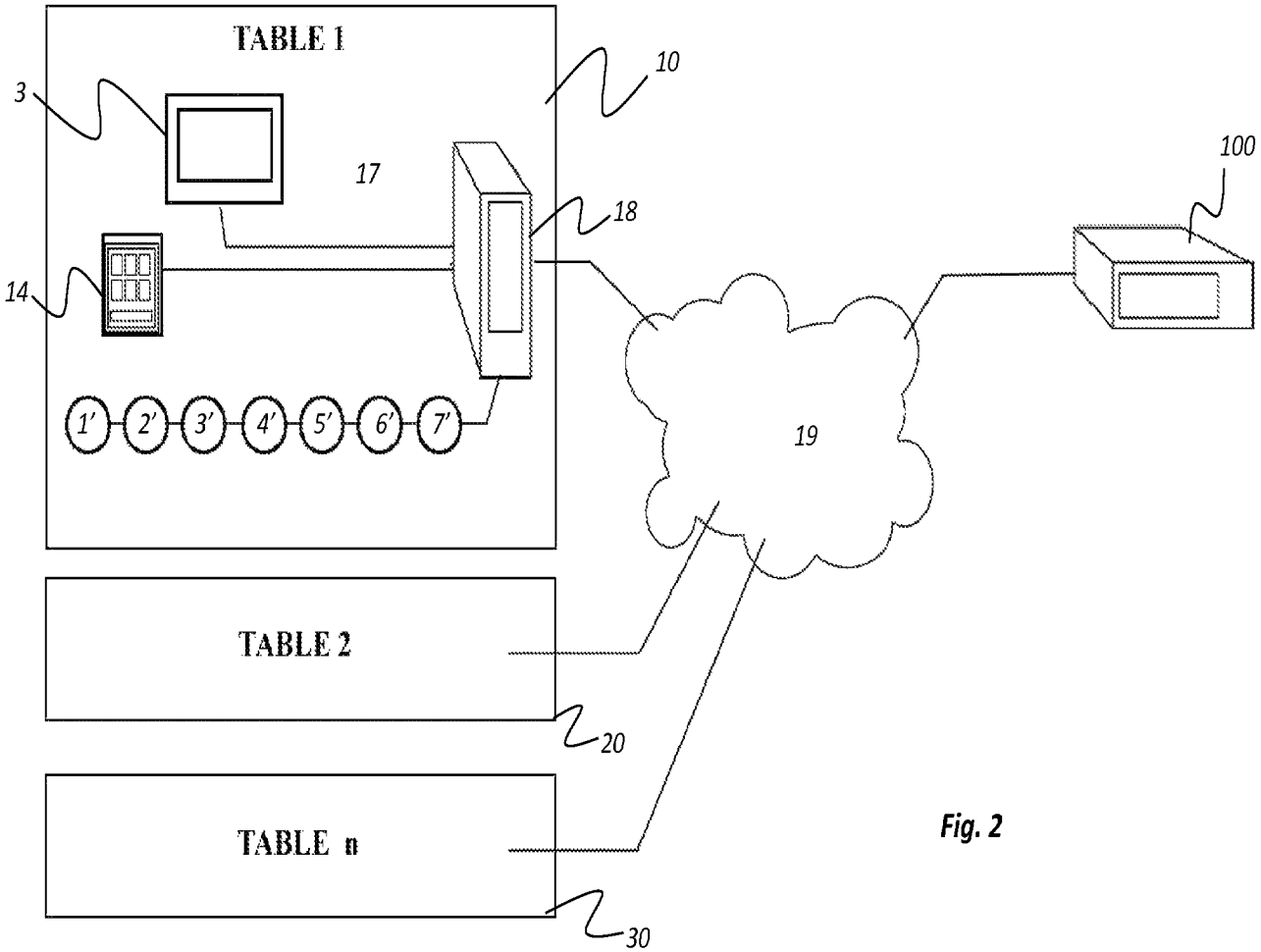
FIG. 2 is a schematic view of a table and casino network in accordance with the invention.

With reference to FIG. 2, the various components of the table are interfaced with a game computer for administering the game and components. In this embodiment the game computer is connected to the components via a table network 17 and includes a table controller 18 and a server. In this embodiment, the server is a remotely located central server 100 connected via a wider casino network 19 to the table controller 18. Other game tables 20, 30 may also be connected to the casino network 19 and central server 100 to allow multiple tables to contribute toward the same jackpot pool. In some forms of the invention, the table controller and central server are integrated and may be situated on the table network, or remotely positioned on the casino.

Where required, both the table controller 18 and sever 100 are include respective microprocessors for processing data, and memory devices for storing data as is known in the art along with appropriate data input and output transfer mechanisms.

Figure 3:
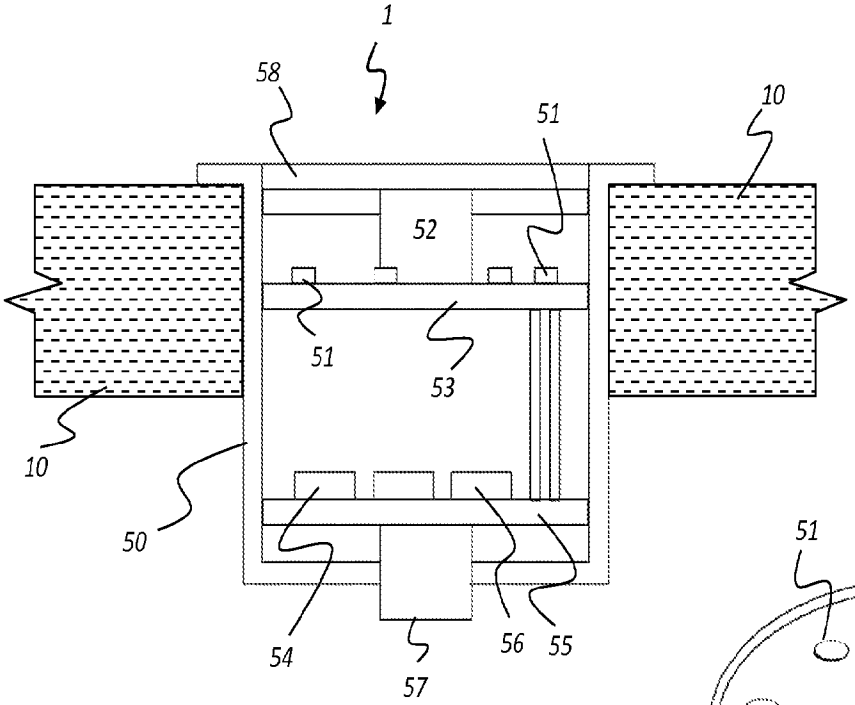
FIG. 3 in a cross sectional schematic view of an embodiment of a players console in accordance with the invention.
Figure 4:
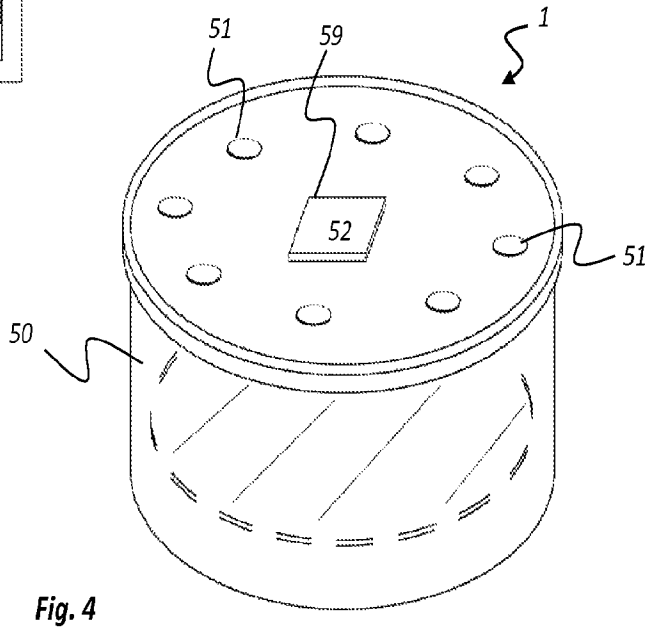
FIG. 4 is a top perspective view of the players console shown in FIG. 3.

In FIGS. 3 and 4, a schematic of a player's console in accordance with the invention is shown. In this embodiment of the invention, each player's console includes an integrated wager registration device to allow players to register a side wager, and a player's indicator. Referring to FIG. 3, the console 1 is mounted within a cut out in the table 10. From the players perspective only an upper surface of the console can be seen in the form of a disc, generally flush with the table surface. In this way the console is unobtrusive and does not restrict movement of game components such as value tokens or cards, yet may be easily observed and accessed by the respective player, the dealer and the other players at the table.

More specifically, in this embodiment, each players console includes a cylindrical housing 50 containing the player's indicator and the registration device. The player's indicator includes an indicator screen forming the upper surface of the console and eight tri-colour LEDs 51 for generating a visual display.

The wager registration device includes a proximity sensor in the form of an infrared transmitter/receiver module (IR module) 52. The module determines when an object is placed over the console on the indicator screen and generates an appropriate signal. In this manner, the indicator screen also forms a receiving location for receiving a betting chip placed over the sensor and console thereby allowing a player to "register" their intention to participate in the auxiliary game. In this embodiment, it will be appreciated that the IR module will not readily determine what type of object is covering the console. Thus, during play of the auxiliary game it is necessary for the dealer to confirm that the appropriate type of betting chip has been used to register the side wager. However, the invention may incorporate a sensor for authenticating that the object is not counterfeit, for instance the object may include RFID tags and the like. Alternatively a sophisticated sensor able to detect patterns or colours may be used in conjunction with appropriate computer software and hardware to recognise such patterns and/or colours on the object.

As shown in FIG. 3, the LED's 51 and module 52 are each mounted on an upper circuit board 53 and connected to and controlled by a microprocessor 54 mounted on a lower circuit board 55. A DIP switch 56, also mounted to the lower circuit board, is provided for setting the console with a distinct address so that the table controller can identify and activate each sensor individually. A connector 57 is provided to connect each console to the table controller.

Referring to FIG. 4, the LED's 51 are arranged in a circumferential array around the proximity module 52. A light diffusing cover 58 is positioned at the top of the console to cover the LEDs and infrared module forming the flush mounted indicator screen of the console and receiving location for betting chips. The cover 58 is generally translucent to hide the LED's and soften the light they emit, but includes a transparent centre 59 behind which the infrared module sits.

By separately controlling the colours, brightness and sequence of illumination of the individual LEDs with the microprocessor, the console is able to generate a range of visual static and dynamic patterns. Patterns that may be generated by the player's indicator include but are not limited to:

- Sparkling—where each LED is assigned random colour and brightness.
- Pulsing—all LEDs are set to one colour, then gradually increase intensity up to the maximum, then gradually decrease the intensity down to the minimum, and so on.
- Spinning—a pattern is displayed on the LEDs, for example 4 showing blue and 4 showing red. This pattern is then advanced by one LED for a short while, and so on.
- Flashing—all LEDs show a given colour for a short while, then extinguish for a short while, and so on.

As will be seen, the patterns may be used to mark different stages of the game. And furthermore, because each console is indexed and separately identifiable, its function including monitoring the signal from its sensor, and control of the indicator activated, individually by the table controller. This allows the table controller to provide a different pattern to each indicator depending on the action of the respective player and the game outcome.

It will be appreciated that the players console may take other forms. In some embodiments rather than combining the player's indicator and side wager registration device into one unit, the two components may be separate. For instance other forms of registration device include a token slot or aperture into which the player must insert a betting chip if they wish to participate in the auxiliary jackpot game. In other embodiments, the registration device may be simpler requiring the player to present a betting chip following which manual activation of a registration switch or button is required by either the player or the dealer.

Likewise the player's indicator may take other forms from more simple lights emitting devices to more complex pixel screen devices capable of displaying complex images, text and the like, particularly as technology develops to make new types of displays economically viable in this application.

In a particular alternative embodiment, the players console is in the form of a touch screen device. The touch screen is capable of not only displaying detailed information to inform the player of the jackpot totals and stages of the game, but also may allow the player to register bets electronically without the use of physical betting chips or tokens. In such a system, the player has access to an account and can transfer credits from the account to participate in both the base game and the auxiliary game.

In order to establish the auxiliary game is it necessary to predetermine several fixed game parameters which are stored in the system memory. The lower and upper limits of the jackpot ("$J_{Lower}$" & "$J_{Upper}$") are set along with the side wager value ("$W_{Entry}$") (each player must pay for entry into the auxiliary game. This amount $W_{Entry}$ will be split into several portions including a contribution portion ($W_{Contrib}$) which will contribute to incrementing the jackpot during play.

The lower jackpot limit ("$J_{Lower}$") is a commencement or seed amount of the jackpot and provides an initial incentive for players to participate in the game. Without a lower jackpot value, the jackpot value will initially be zero as the entire previous jackpot accumulated amount will have been paid out to the previous winner. In order to fund the jackpot commencement amount, a seed portion $W_{Seed}$ of each side bet $W_{Entry}$ is normally set aside in a jackpot seed pool. Thus, at initialisation or following a win, the commencement funds to initiate the jackpot at $J_{Lower}$ are taken from the accumulated seed pool.

Normally, another portion of each side wager value $W_{Entry}$ is directed toward the house and government taxes if required. This will be referred to as the house portion or $W_{House}$. As such each side wager may be thought as:

$$W_{Entry}=W_{Contrib}+W_{Seed}+W_{House}$$

As previously indicated, the upper jackpot limit ($J_{Upper}$) should be selected to prevent the win value $J_{Win}$ being set at unrealistic levels. In addition, as will be seen, setting an upper jackpot value can provide further incentive for the players to participate in the auxiliary game.

The manner in which these value factors are chosen may be numerous and complex. There are both practical necessities that must be accounted for as well as player incentive considerations. For instance, the side wager value should generally correspond to the wager limits of the base game. That is to say, choosing a side wager value far in excess of the amounts being wagered in the base game is unlikely to persuade players to participate the auxiliary game. In addition, the boundaries of the jackpot may be selected will determine not only the size of the prize but also the frequency of which it is won. While there are also more complex issues which relate to player behaviour to consider, they are not significantly different from the player behaviour considerations of other gambling games and generally relate to simple probability, player motivation and the returns desired and/or required for players, house and government.

The above parameters are generally permanent and define the jackpot game. They generally do not change from jackpot win to jackpot win. However, as previously noted, an RNG is used to generate data used to determine whether a player has won the jackpot thereby ensuring that the winning event is "random" and not related to the base game. In one embodiment the RNG is used to select a "win" value ("$J_{Win}$"), before initialisation of each jackpot. The win value is selected between the predetermined jackpot limits such that ($J_{Lower}<J_{Win}<=J_{Upper}$). This win value is stored in memory until the jackpot is won but then may be discarded. It is reselected each time the jackpot is initialised following each jackpot win otherwise the players would become aware of the win value.

In an alternative form of the invention, the RNG is used to generate fresh data for determining a win every time a side wager is processed. This reduces the length of time the win indicating data must be stored in the system memory and as such is seen to hold security advantages.

During play of the base game, each base game player is provided an individual player station at the game table. It is only possible to include as many players at the table as there are player's stations. However it is not necessary that each and every player's station is occupied for the game to progress. Furthermore, while the term "player" generally refers to an individual, it is also used herein to refer to a "team" comprising two or more individuals playing the same hand collectively.

Prior to commencing the base game, a period of time or "betting phase" is provided to allow players to place wagers on both the base game and the auxiliary game should they choose. The betting phase begins when the dealer keys an initiating command into the table controller with the dealer's console. Initiating the betting phase, clears the table controller of any residual betting information and sets the players indicators to provide a visual cue to indicate the betting phase is in progress.

As previously noted, each of the players indicators are programmed to display particular static or dynamic patterns. Each of the patterns corresponds to a particular state of the indicator and/or phase of the game. In the preferred embodiment, the indicator provides distinct patterns for the following phases of the game/state of indicator:

Betting Phase/No Side Wager Registered
Betting Phase/Side Wager Registered
Bets Locked/No Side Wager Confirmed
Bets Locked/Side Wager Confirmed While in some systems, the player's indicators may be capable of providing an explicit visual cue that the system is ready to receive bets, in this system, the players indicators simply show a predetermined "Betting Phase/No Side Wager Registered" pattern. Initially, if unfamiliar with the system, the players may not immediately perceive the accepting bets pattern as a cue that bets may be placed. Consequently, the cue from the indicators may be supplemented by verbal advice from the dealer and/or the more explicit visual cues on the jackpot display. With experience however, the players, once accustomed to the system will recognise particular patters displayed by the players' indicators as indicative of certain phases of the game.

In order to participate in the auxiliary game, the players must register a side wager by placing a betting chip or token over their respective player's console. In doing so, the sensor of the respective token acceptor detects the presence of the token and switches the player's indicator to a second visual cue "Betting Phase/Side Wager Registered" which is distinct from the first. This provides a visual indication that a side wager has been placed at a particular players console by a respective player. The player and dealer can thus visually confirm that the system has acknowledged placement of a side wager. In addition the dealer can easily scan the table and recognise which players have registered side bets and confirm that the player has used the appropriate betting chip.

If the player then removes the token from the bet acceptor during the betting phase having decided not to make a side wager after all, the indicator returns to the "Betting Phase/No Side Wager Registered" pattern. Provided the betting phase is in progress, the player may change their bet as many times as they like.

After a suitable period of time, the dealer ends the betting phase by keying an appropriate command into the table controller via the dealer's console. Preferably the players are forewarned by the dealer and/or by the system before the betting phase ends to enable them to check their side wagers and make any final adjustments. Furthermore, the dealer visually confirms that all the side wagers have been made appropriately.

In most cases the side bet is a fixed value and as such the betting chips used to register a side bet will be visually identical and readily identifiable by the dealer. In this regard the same betting chips that are used in the base game may also be used to register the side bet. While the betting chips may represent a variety of values, chips of different values are normally visually distinct. Most often, chips of the same value will appear more or less identical having the same marking and normally the same colour. Thus the side bet entry amount $J_{Entry}$ will be set at a value corresponding to one of the chip values such that a particular betting chip may be used to indicate participation in the side game.

In order to aid visual identification that the correct betting chip has been used, the players indicator may be configured to display a pattern visually coded to the chip before and/or after the chip is detected. This way if a chip of the wrong amount is used to register a side bet, it may be more easily visual identified by the dealer as being incorrect. It is noted that "visually coded" may mean the same, similar or a contrasting colour and/or a pattern which matches or complements the pattern on the chip.

However in some embodiments, the system may allow for side bets of variable values. In one implementation of variable amount side betting, the player must indicate to the dealer the value of the intended side bet. The dealer will then record, via the dealer input panel 15 the value of the side bet the player would like to make. Of course allowing variable amount side wagers places a greater burden on the dealer to determine that the correct betting chip is used and matches the intended side wager as recorded. Accordingly, it is preferable that the value of the side bet correspond to a particular chip value, thereby limiting variable side wagers to those values corresponding to the values of available chips. Again, as the value of each players side bet is entered into the system, the system adjusts the pattern displayed on each players' indicator to visually correspond to the particular chip value used by each player. Thus each player will have an indicator pattern and/or colour which is coded to the chip pattern and/or colour of a chip value corresponding to the intended side bet value as recorded by the system.

When the dealer ends the betting phase, the table controller instructs the player's indicators to change the pattern displayed on each indicator from the betting phase patterns to the bets locked patterns. At the change of phase, the state of the token acceptors cannot be changed by removal or placement of a token. The indicators having a side wagers confirmed will show the "Bets Locked/Side Wager Confirmed" pattern while where no side wager has been made, the indicators show the pattern indicating "Bets Locked/No Side Wager Confirmed". Again, the indicators provide a clear visual signal of which players are participating in the auxiliary game. At this stage the wagered betting tokens used by the players to indicated side wagers may be collected from the token acceptors by the dealer and returned to the house.

In addition, once the bets are locked, based on the signal from each sensor, the table controller compiles a table game log of which players have made a side wager indexed by their location at the table. For instance, with reference to FIG. 1, if players at positions 2, 4, 5 and 7 have made side wagers, the controller compiles these references in a table game log including a game reference number and table number, and sends the log to the central sever over the network. This way, each side wager can be traced back to the table and player position. If bets of different amounts have been recorded, this information is also passed to the server.

To determine if any of the side wagers have won the jackpot, the central server processes the table game log by allocating the predetermined portions of each referenced wager to the progressive jackpot total consecutively. The wagers in the table log may be processed by the server in a sequential order, a predetermined order or in any random or partially randomised order. However, each referenced wager is processed individually in two steps.

In the first step, the accumulated current progressive jackpot total ("$J_{Current}$") is incremented by the predetermined portion ($W_{Contrib}$) of the wager to arrive at the new progressive jackpot total ($J_{Current}+W_{Contrib}=J_{Current}$). In the second step, the new jackpot total is compared against the secret, predetermined "win" value ($J_{Win}$) for the jackpot stored by the server. If the new jackpot total is below the win value (If $J_{Current}<J_{Win}$ is True), then the wager is not a winner, and the server discards the current wager and proceeds to process the next reference side wager in the same manner until all the jackpot side wagers in the log have been processed. The jackpot display is updated in line with the progressive jackpot total as it is incremented.

On the other hand, a win is triggered if the new progressive jackpot total matches or is greater than the win value (If $J_{Current}>=J_{Win}$ is True). Should this occur, the server records the reference position of the wager index and table from the log along with the current progressive jackpot total which becomes the winning payout value.

As previously noted, in an alternative form of the invention, the system is configured to use the RNG each time a referenced wager is processed in a preliminary step.

In one form, the system selects a win value such that ($J_{Current}<J_{Win}<=J_{Upper}$) before proceeding to increment the accumulated current progressive jackpot total ("$J_{Current}$") by the predetermined portion ($W_{Contrib}$) of the side wager to arrive at the new progressive jackpot total ($J_{Current}+W_{Contrib}=J_{Current}$). The new jackpot total is compared against the new secret, predetermined "win" value ($J_{Win}$) for the jackpot. In another form, the probability of the next contribution winning is calculated as:

Probability of next contribution win=1/(Number of Contributions Remaining); and

Number of Contributions Remaining=$(J_{Upper}-J_{Current})/W_{Contrib}$

The RNG is then used to generate a random number to between 0 and 1 (to 4 decimal places). If that number is less than the chance of the next contribution winning, the jackpot is won. One form of algorithm implemented by the microprocessor of the system for calculating the Mystery Jackpot can be as follows:

```
#define UPPER 1000
#define CONTRIBUTION 5
int CheckMysteryWon( )
{
  // Return: 0 if no mystery won, else amount won.
  int nMaxGamesToWin = (UPPER - nCurrentValue) / CONTRIBUTION;
  nCurrentValue += CONTRIBUTION;
  float fProbWin = 1.0 / (float)nMaxGamesToWin;
  float fRnd = (float)rand( ) / (float)RAND_MAX; // random number between 0 and 1
  if (fRnd < fProbWin)
    return nCurrentValue; // WINNER!
  else
    return 0;             // NO WINNER YET
}
```

If a win is determined, before any other side wagers can be processed, even from the same table game log, the jackpot must be re-established. This involves resetting both the progressive jackpot total to a base value, usually the lower limit of the jackpot range and regenerating and storing a new secret win value with the RNG.

Once reset, the central server may continue processing the remaining side wagers in the table game log. Any winners from the log are then notified to the respective table controller at the table where the wager was made. The notification message contains the player position of the winner, and the value of the jackpot prize. Receipt of a win notification by the table controller places the table into a "win mode".

In "win mode" the controller begins a predetermined routine of notifying the players and the dealer of the winner or winners. This includes a sequence of illuminating the player indicators to indicate that a side wager, taken at the table has won the jackpot prize. This sequence is designed to build suspense and excitement in the players at the table without initially notifying them of the actual winner. The sequence may take any one of various forms including but not limited to:

- "round robin" illumination where each player's console is briefly illuminated in turn, with the illuminated player's console going in either a clockwise or counter-clockwise direction around the table; or
- "swing" illumination where each player's console is briefly illuminated in turn with the direction of illumination reversing each time the first or last player position is reached; and/or
- "random" illumination, where random player's consoles briefly illuminate with no apparent pattern.

The illumination sequence may add further suspense and excitement to the players by:

- slowing down and/or speeding up during the course of the sequencing; and/or
- illuminating the each player's console in various different colours; and/or
- displaying different effects within each player's console such as spinning, pulsating, blinking, and so on.

At the conclusion of the sequence, it will be obvious which player is the winner of the mystery jackpot due to the fact that the winning player's indicator will display a pattern unique from the other players' indicators. For instance, the winning player's indicator may stay illuminated and/or otherwise showing a unique pattern (such as blinking, spinning, pulsating, and so on) that clearly differentiates the end phase from the sequencing phase and from the other non winning players' indictors.

The winning sequence may incorporate the illuminating spots for player positions for which no players are participating in the optional wager. Obviously these non-played positions cannot be winners and where the winning sequence includes these non-played positions, it cannot end on such a position. However their inclusion in the sequences adds to the visual impact of the light show.

The jackpot display may also be used to supplement the winning sequence both to initially indicate that there has been a winner, and subsequently to also indicate the player that has won. Finally, the dealer will pay the winning player in tokens or by issuing a voucher for redemption.

Due to the nature of mystery jackpots it is possible for more than one win to occur per game. This can occur if the new generated mystery value is low, and there are further contributions to be processed. In this case each winner will be dealt with sequentially in an identical manner. Once all winners are processed the base game will commence. Alternatively the sequence may indicate both winners concurrently.

It is noted that the system may be set to initiate the winning sequence at predetermined times in the sequence of the base game. That may include prior to commencement of the base game, for instance prior to cards for the base game being dealt should the base game require cards; at the conclusion of the base game once the dealer keys into the table controller the round is complete; or in some cases, it may interrupt the progress of the base game.

While the above example has been described with reference to one table, the invention extends to implementations wherein multiple live gaming tables are connected to contribute to a single jackpot pool. As such the central server processes the side wagers from each participating table. In this way, the jackpot turnover is increased and jackpots accrue more rapidly than if limited to one table. Advantageously, prizes may be larger and/or be won more regularly depending on the predetermined jackpot parameters.

In some embodiments of the system, more than one progressive jackpot may be included in the auxiliary game and run concurrently. In such cases, a portion of the side wager value ($W_{Contrib}$) contributes towards each of the jackpots. In further embodiments, the game may provide for variable side wager entry values. In practice the value of the side wager contributing towards the jackpot would increase proportionally with the value of the side wager. As such a player contributing say, ten times the side wager, would contribute ten times the value to the jackpot and have correspondingly a ten times greater chance that their side wager contribution increases the jackpot to the secret win value. In this embodiment the registration device includes means for registering and recording the side wager value.

In other embodiments one or more mystery progressive jackpot games and one or more event based progressive jackpots may be run concurrently in the same auxiliary game.

By way of example, in a jackpot using value units as "credits", an auxiliary game establishes three generally independent progressive jackpot games each having different payout amounts such as:

- A low value, mystery progressive first jackpot with a lower limit of 10,000 credits and an upper limit of 20,000 credits. The RNG selects a first secret win value between these two limits. The first jackpot is won by the side wager which increases the first progressive jackpot total to the first secret win value.
- A high value, mystery progressive second jackpot with a lower limit of 100,000 credits and an upper limit of 200,000 credits. The RNG selects a second secret win value between these two limits. The second jackpot is won by the side wager which increases the second progressive jackpot total to the second secret win value.
- An event based progressive third jackpot having a lower limit of 200,000 credits. No upper range of this jackpot is required. The third jackpot is won by the player having made a side wager for a game and having a predetermined event occur in that game—for instance a Royal Flush in poker.

In this example, the value of the side wager to enter the auxiliary game is set at 200 credits. This amount provides participating players with the chance of winning any one of the three jackpots in a particular round or hand of the base table game.

From this 200 credit amount, a first predetermined proportion of each side wager is allocated toward the first jackpot, a second predetermined proportion of each side wager is allocated toward the second jackpot, and a third predetermined proportion of each side wager is allocated toward the third jackpot. The amounts allocated to each jackpot will depend upon a range of factors including the side bet amount, the size and number of the jackpot limits and the frequency with which the jackpots are intended to be won.

It will be appreciated that in the case of the mystery progressive jackpots, on average, the mystery win value will be the mid-point between the predetermined low and high limits. Thus, in the case of the first and second jackpot examples, the average win amount will be 15,000 credits and 150,000 credits respectively. It is then possible to calculate for each jackpot, the average number of side wagers between each jackpot win for a given predetermined portion from the side wager. For instance, if 25 credits are allocated to each jackpot from each side wager, it will on average take 200 side wagers between wins of the first jackpot and 2000 side wagers between wins of the second jackpot.

In this embodiment it is intended that the, low value mystery first jackpot is won more frequently than the high value mystery second jackpot. The third event based progressive jackpot should be won less frequently that either the first or second jackpots. In this way the players are provided with three levels of incentive to participate in the auxiliary game.

Moreover, based on historical data, the first jackpot can be configured to be won at least once during the average period of time an average players game spends at a base game table. In this way the player is likely to see at least one jackpot win. Even if the winner is not the player, it provides incentive for the player to continue playing.

Figure 5:
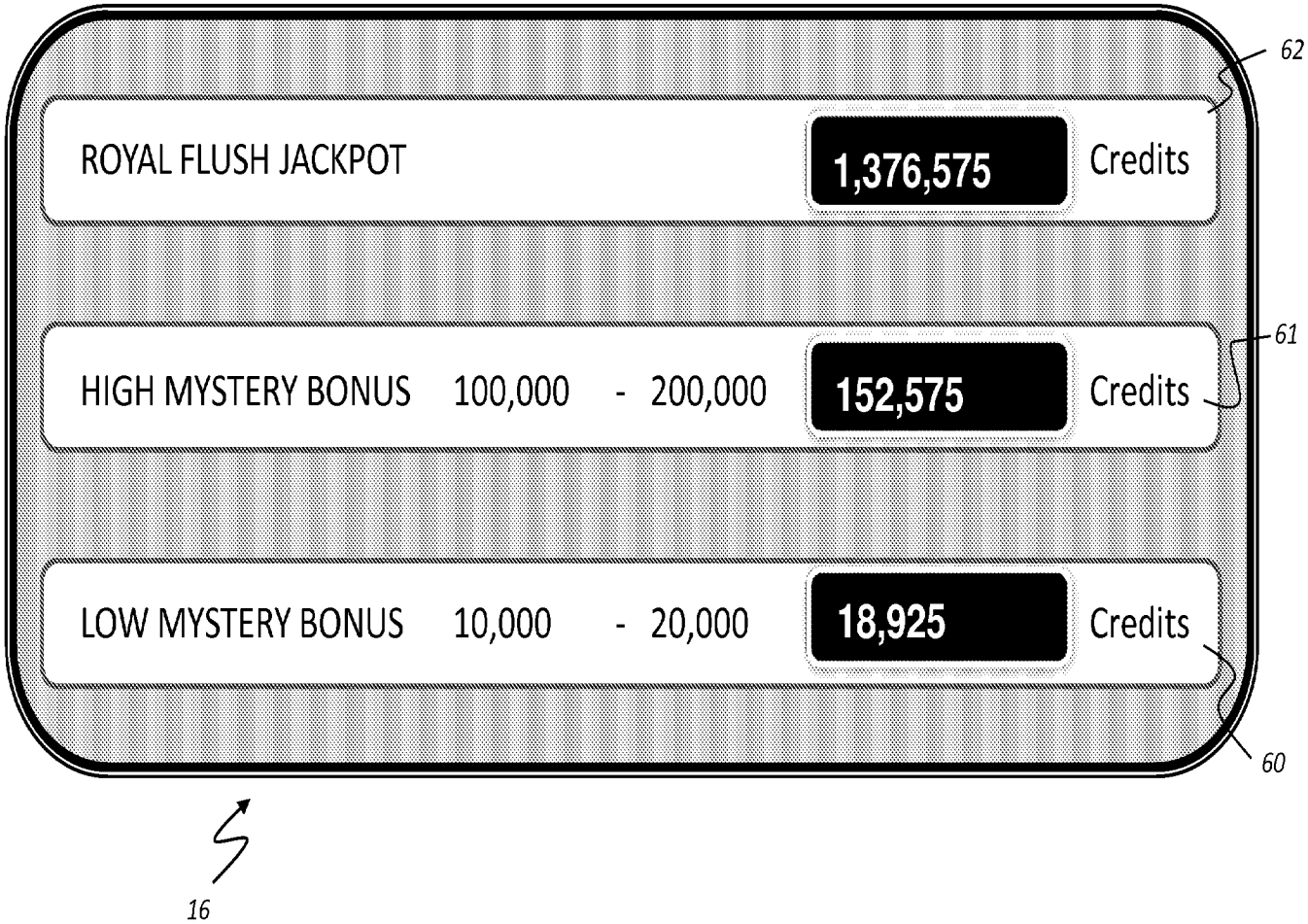
FIG. 5 is a schematic of a jackpot display in accordance with one embodiment of the invention.

The incentive is reinforced by the jackpot display viewable at each table. FIG. 5 shows an embodiment of a jackpot display set to the three jackpot example.

The lowermost section 60 of the display provides information on the low value, mystery progressive first jackpot. From the display the players can identify that the jackpot limits are between 10,000 and 20,000 credits. At this particular instance in time, the current jackpot level is at 18,925 credits.

The mid section 61 of the display provides information on the high level mystery progressive second jackpot and shows it to have lower and upper limits of 100,000 and 200,000 respectively. The current value is displayed at 152,575.

Moreover, it will be appreciated that in the case of mystery progressive jackpots, the higher the jackpot rises towards its predetermined upper limit, the greater the probability that a given side bet will win the jackpot.

For instance referring to FIG. 5 and the low value mystery progressive first jackpot example, as noted, the jackpot is won when the jackpot value increases beyond a secret value selected between the jackpot limits of 10,000 and 20,000 credits. Each side wager makes a set contribution of 25 credits to the mystery jackpot total. Accordingly it takes 400 side bets to increase the jackpot from the 10,000 lower level to the 20,000 upper level. If the jackpot has only recently been rest and thus the jackpot value is only 10,025 credits, the jackpot will be won on one of the next 399 side bets. On the other hand if the jackpot has accumulated to a value of 19,900 credits without being won, the jack pot must be won by one of the next 4 side bets. Thus the chance of a player winning the jackpot prize will be greater as the jackpot approaches the upper limit.

Accordingly, as the mystery progressive jackpots increase in value, the players have greater incentive to participate in the auxiliary game because they have a greater probability of winning the jackpot and a greater prize.

Returning to FIG. 5, the uppermost section 62 of the display shows the current progressive jackpot prize the players stand to wind in the event based jackpot is 1,376,560 credits. Clearly in order to win this jackpot the players must obtain a Royal Flush in the base game. Accordingly, in contrast to the mystery progressive jackpots, the probability of winning does not change as the jackpot increase.

Mode Betting

In an alternative form the invention proposes a jackpot structure devised to provide additional incentive for players to participate in a side wager. This jackpot structure may be applied to any progressive jackpot system where contributions are made to two or more jackpot pools from each side wager made. A first jackpot pool is configured as an event progressive jackpot where the pool is awarded when a player receives a particular, predetermined hand or set of base game events. At least one other jackpot pool is configured as a mystery progressive jackpot as previously disclosed where the jackpot pool is awarded to a player where that players contribution to the pool increments it equal to or beyond a mystery jackpot win value. In this respect the embodiment is similar to the previous described embodiments.

It will be appreciated that due to the jackpot structure, one significant difference between the event based progressive and the mystery progressive is that the mystery progressive has a set upper bound. On the other hand, the winner of an event based progressive is determined by a predetermined game outcome which may or may not occur each game. As such, it is normal for there to be no upper limit imposed on event based jackpots particularly where the probability of the game outcome occurring is relatively low.

As previously noted, a fixed, predetermined portion of each side wager is added to each jackpot pool when a side wager is made. Thus where $W_{Contrib}$ is the total amount of each side wager contributed towards increasing progressive jackpots and $W_{Contrib(Event)}$ and $W_{Contrib(M)}$ are the amounts contributed toward increasing the event based jackpot and mystery progressive jackpot respectively, then:

$$W_{Contrib}=W_{Contrib(Event)}+W_{Contrib(Mystery)}$$

As we have seen $W_{Contrib(Event)}$ only increases the value of the jackpot and has no bearing on the player's probability of winning.

On the other hand, $W_{Contrib(Mystery)}$ is an important factor in determining whether the player wins the jackpot.

It has previously been noted that as a mystery progressive jackpot increases in size, from the lower bound $J_{lower}$, to the upper bound $J_{upper}$, the probability of any individual wager winning the jackpot increases, assuming the contribution to that jackpot pool remains constant. Thus, as the mystery jackpot approaches the upper limit the players are increasingly motivated to make a side wager because both the probability of winning increases and the size of the prize increases.

In contrast, as an event-based jackpot increases, there is no increase in the probability of winning the jackpot because the jackpot win is determined by outcomes in the base game which are unrelated to the size of the jackpot and $W_{Contrib(Event)}$. There is an increased motivation for the players due to the increasing size of the prize pool however, as the jackpot pool increases, each proportion of the side wager contributing to the size of the jackpot pool is a smaller fraction of the jackpot pool. Additionally, as the event jackpot pool becomes extremely large, players becoming increasingly desensitised to changes in the jackpot pool size. Put simply, the player's additional motivation to win a jackpot of 1,050,000 credits over a jackpot of 1,000,000 credits is considered smaller than the difference in motivational levels of a player to win a jackpot of 100,000 over a jackpot of 50,000 credits.

As such, the invention proposes a variable rate of the proportion allocated to each jackpot pool as the event based jackpot grows, preferably increasing the proportion of the side wager contributed toward the mystery based jackpot and reducing the proportion contributed toward the event based jackpot. This is represented in FIGS. 6 to 8.

Specifically, the chart shown in FIG. 6 provides a comparative plot of the respective contribution amounts to each of the event based $W_{Contrib(Event)}$ and Mystery $W_{Contrib(Mystery)}$ jackpots against the value of the event based jackpot total ($J_{Event}$). The total contribution is shown at $W_{Contrib}$.

The chart is divided into two parts each representing a different mode of operation. It can be seen that below a predetermined value of the Event jackpot $F_{Event}$ the system operates in a first mode and above the predetermined value the system operates in a second mode. It can be seen that the comparative contributions directed toward each of the jackpots changes such that a greater proportion of $W_{Contrib}$ is directed toward the Mystery jackpot and a smaller proportion of $W_{Contrib}$ is directed toward the Event jackpot in the second mode as the event jackpot passes the predetermined value $F_{Event}$. This results in the event-based jackpot pool increasing more slowly and the mystery progressive jackpot pool increasing more rapidly in the second mode than in the first.

Consequently, for the player, the probability of winning the mystery progressive pool is increased both due to the aforementioned increasing probability as the jackpot climbs but also because each side wager contributes a greater proportion toward the jackpot pool and therefore a greater chance that increase takes the jackpot pool beyond the winning mystery amount. As a result, once the second mode is triggered, there is an increased motivation for the player to elect to participate in the side game.

The players are notified once the second mode is triggered by either the dealer or by means of a players display screen.

Returning to FIG. 6 it should be noted that the actual comparative values between the mystery and event contributions shown in the chart, within each mode are arbitrary. It is the comparison of the respective contributions between each mode which is important. For instance while in FIG. 6 the amount contributed to the mystery jackpot in the first mode appears as more than the amount contributed to the event jackpot, this may not be the case and the amount contributed to the mystery jackpot may be more than, less than or equal to the amount contributed to the event jackpot.

FIGS. 7 and 8 show alternative methods of varying the distribution of contribution between event and mystery jackpots. In FIG. 7 rather than a step increase at the predetermined value $F_{Event}$ of the event jackpot value, the distribution is adjusted according to a mathematical function. This may be a linear change, a multiple step change or a logarithmic or exponential function as shown in FIG. 7. There may be multiple predetermined trigger values $F_{Event}$ or no set trigger value as shown in FIG. 8.

Variable Amount Side Betting

In another form of the invention, the system is configured to provide for side bets of variable amounts. One difficulty with providing variable amount side bets is that in order to motive a player to elect to increase the value of the side bet, there must be a corresponding increase in payout and/or probability of winning. In a jackpot arrangement generally the jackpot amount is determined by the level of betting and the payout cannot be adjusted easily. In the case of an event based jackpot, as we have seen the probability of a win is tied to an event, usually in the base game and thus cannot easily be altered.

The invention however proposes a method of providing for variable amount side bets by increasing or decreasing the contribution towards a mystery jackpot by an amount proportional to the increase/decrease of the side wager. As noted, because the probability of winning a mystery based jackpot is intrinsically tied with the amount the jackpot is increased by each side bet contribution, the probability of winning the mystery jackpot is automatically adjusted with the value of the side bet. Thus mystery progressive jackpots may account more simply for variable amount side wagers.

In the case where the side bet is configured only for a mystery progressive jackpot, any increase in the side wager increases the contribution toward the jackpot by a correspondingly proportional amount. For instance if the side wager is doubled, the amount contribution toward the jackpot is also doubled.

In the case of multiple jackpots and particularly where one of those jackpots is an event based jackpot, the situation maybe more complicated. As noted it is generally difficult to adjust the payout or probability of an event based jackpot to compensate for any increase in side wager amount, however the probability of a win in an mystery progressive may be adjusted as above. Therefore in a progressive system having one or more mystery progressives and an event based progressive, any increase above a predetermined base side wager amount is directed solely toward one or more of the mystery progressive jackpots and not toward the event based progressive jackpots.

Referring again to the system of the invention proposed in FIG. 5 where the base side wager is set at 200 credits such that 25 credits are directed toward each of the three jackpots. As noted any increase in this base side wager amount may be directed toward the mystery progressive jackpots only. For instance an increase of the side wager to 400 credits would mean that the increase of 200 credits is directed only towards one or both of the mystery jackpots. In contrast the contribution towards the event jackpot remains as the base level of 25 credits. The contribution of the side wager directed toward increasing the mystery progressive jackpots might increase from 25 credits each by, for instance, 50 credits to 75 credits each.

This incentivises the player to make a larger size side bet particularly as one or more of the mystery jackpots approach the upper bound.

It will be appreciated that the present invention provides for a secure means of enrolling players in a table wide jackpot system accepting and recording player wagers, communicating to the players the various stages of the game including winnings. The system and method are readily up scalable to multiple tables and may be applied across different games of chance.

It will be appreciated that the present invention combines additional incentives over a standard event based progressive jackpot. The mystery random prize occurs frequently to reinforce player appeal and motivation and a sequence of light devices create an effect which enhances the excitement of anticipating which player has won the mystery prize. The combination of these elements together creates a much more appealing game for the player. It will be appreciated that in these and other respects, the invention represents a practical and commercially significant improvement over the prior art.

Unless specifically stated otherwise, as apparent from the following discussions, it is appreciated that throughout the specification discussions utilizing terms such as "processing," "computing," "calculating," "determining", analyzing" or the like, refer to the action and/or processes of a computer or computing system, or similar electronic computing component, that manipulate and/or transform data represented as physical, such as electronic, quantities into other data similarly represented as physical quantities.

In a similar manner, the term "processor" may refer to any device or portion of a device that processes electronic data, e.g., from registers and/or memory to transform that electronic data into other electronic data that, e.g., may be stored in registers and/or memory. A "computer" or a "computing machine" or a "computing platform" may include one or more processors.

The methodologies described herein are, in one embodiment, performable by one or more processors that accept computer-readable (also called machine-readable) code containing a set of instructions that when executed by one or more of the processors carry out at least one of the methods described herein. Any processor capable of executing a set of instructions (sequential or otherwise) that specify actions to be taken are included. Thus, one example is a typical processing system that includes one or more processors. Each processor may include one or more of a CPU, a graphics processing unit, and a programmable DSP unit. The processing system further may include a memory subsystem including main RAM and/or a static RAM, and/or ROM. A bus subsystem may be included for communicating between the components. The processing system further may be a distributed processing system with processors coupled by a network. If the processing system requires a display, such a display may be included, e.g., a liquid crystal display (LCD) or a cathode ray tube (CRT) display. If manual data entry is required, the processing system also includes an input device such as one or more of an alphanumeric input unit such as a keyboard, a pointing control device such as a mouse, and so forth. The term memory unit as used herein, if clear from the context and unless explicitly stated otherwise, also encompasses a storage system such as a disk drive unit. The processing system in some configurations may include a sound output device, and a network interface device. The memory subsystem thus includes a computer-readable carrier medium that carries computer-readable code (e.g., software) including a set of instructions to cause performing, when executed by one or more processors, one of more of the methods described herein. Note that when the method includes several elements, e.g., several steps, no ordering of such elements is implied, unless specifically stated. The software may reside in the hard disk, or may also reside, completely or at least partially, within the RAM and/or within the processor during execution thereof by the computer system. Thus, the memory and the processor also constitute computer-readable carrier medium carrying computer-readable code.

Furthermore, a computer-readable carrier medium may form, or be included in a computer program product.

In alternative embodiments, the one or more processors operate as a standalone device or may be connected, e.g., networked to other processor(s), in a networked deployment, the one or more processors may operate in the capacity of a server or a user machine in server-user network environment, or as a peer machine in a peer-to-peer or distributed network environment. The one or more processors may form a personal computer (PC), a tablet PC, a set-top box (STB), a Personal Digital Assistant (PDA), a cellular telephone, a web appliance, a network router, switch or bridge, or any machine capable of executing a set of instructions (sequential or otherwise) that specify actions to be taken by that machine.

Note that while some diagrams only show a single processor and a single memory that carries the computer-readable code, those in the art will understand that many of the components described above are included, but not explicitly shown or described in order not to obscure the inventive aspect. For example, while only a single machine is illustrated, the term "machine" shall also be taken to include any collection of machines that individually or jointly execute a set (or multiple sets) of instructions to perform any one or more of the methodologies discussed herein.

Thus, one embodiment of each of the methods described herein is in the form of a computer-readable carrier medium carrying a set of instructions, e.g., a computer program that is for execution on one or more processors, e.g., one or more processors that are part of web server arrangement. Thus, as will be appreciated by those skilled in the art, embodiments of the present invention may be embodied as a method, an apparatus such as a special purpose apparatus, an apparatus such as a data processing system, or a computer-readable carrier medium, e.g., a computer program product. The computer-readable carrier medium carries computer readable code including a set of instructions that when executed on one or more processors cause the processor or processors to implement a method. Accordingly, aspects of the present invention may take the form of a method, an entirely hardware embodiment, an entirely software embodiment or an embodiment combining software and hardware aspects. Furthermore, the present invention may take the form of carrier medium (e.g., a computer program product on a computer-readable storage medium) carrying computer-readable program code embodied in the medium.

The software may further be transmitted or received over a network via a network interface device. While the carrier medium is shown in an exemplary embodiment to be a single medium, the term "carrier medium" should be taken to include a single medium or multiple media (e.g., a centralized or distributed database, and/or associated caches and servers) that store the one or more sets of instructions. The term "carrier medium" shall also be taken to include any medium that is capable of storing, encoding or carrying a set of instructions for execution by one or more of the processors and that cause the one or more processors to perform any one or more of the methodologies of the present invention. A carrier medium may take many forms, including but not limited to, non-volatile media, volatile media, and transmission media. Non-volatile media includes, for example, optical, magnetic disks, and magneto-optical disks. Volatile media includes dynamic memory, such as main memory. Transmission media includes coaxial cables, copper wire and fiber optics, including the wires that comprise a bus subsystem. Transmission media also may also take the form of acoustic or light waves, such as those generated during radio wave and infrared data communications. For example, the term "carrier medium" shall accordingly be taken to included, but not be limited to, solid-state memories, a computer product embodied in optical and magnetic media; a medium bearing a propagated signal detectable by at least one processor of one or more processors and representing a set of instructions that, when executed, implement a method; a carrier wave bearing a propagated signal detectable by at least one processor of the one or more processors and representing the set of instructions a propagated signal and representing the set of instructions; and a transmission medium in a network bearing a propagated signal detectable by at least one processor of the one or more processors and representing the set of instructions.

It will be understood that the steps of methods discussed are performed in one embodiment by an appropriate processor (or processors) of a processing (i.e., computer) system executing instructions (computer-readable code) stored in storage. It will also be understood that the invention is not limited to any particular implementation or programming technique and that the invention may be implemented using any appropriate techniques for implementing the functionality described herein. The invention is not limited to any particular programming language or operating system.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that in the above description of exemplary embodiments of the invention, various features of the invention are sometimes grouped together in a single embodiment, FIG., or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term coupled, when used in the claims, should not be interpreted as being limited to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

The invention claimed is:

1. A gaming apparatus, comprising:

a gaming table comprising:

a. a first table area on which a table game is played;

b. a second table area comprising a number of side wager betting positions;

c. a sensor apparatus to:

i. detect the presence of gaming chips at a side wager betting position; and ii. generate, in response to that detection, a signal identifying the side wager betting position and a side wager value; and d. a plurality of indicators to display auxiliary game related data related to respective side wager betting positions;

a game computer in communication with the sensor apparatus and the plurality of indicators, the game computer comprising:

a first controller to compile a game log to correlate, for each side wager betting position wherein a side wager has been detected, the side wager betting position and the value of the side wager detected;

a memory device to store said game log;

a first mystery jackpot range between a first lower jackpot limit ($J_{Lower}$) and a first upper jackpot limit ($J_{Upper}$);

a side wager value ($W_{Entry}$) for participating in the auxiliary game;

a first mystery jackpot contribution portion ($W_{Contrib}$) of the side wager value ($W_{Entry}$) to accumulate the first mystery jackpot prize pool; and a first mystery jackpot prize pool value ($J_{Current}$) representing the accumulated mystery progressive jackpot prize pool; and a random number representing a first secret first mystery jackpot win value ($J_{Win}$) within the first jackpot range;

a random number generator to generate random number data;

a processor to determine a winning side wager betting position of the first auxiliary game from among participating side wager betting positions on the basis of generated random number data; wherein the processor is operable to select a winner of the first game by consecutively processing each side wager placed at a side wager betting position by:

calculating a new first mystery jackpot prize pool by incrementing the stored first mystery jackpot prize pool value ($J_{Current}$) by the first mystery jackpot contribution portion ($W_{Contrib}$);

storing the new first jackpot prize pool value as the first mystery jackpot prize pool value ($J_{Current}$); and when the first mystery jackpot prize pool value is equal to or greater than the secret first mystery jackpot win value:

nominating the side wager betting position associated with the last-processed side wager as a winner of the first game;

saving the first mystery jackpot prize pool value ($J_{Current}$) as the first mystery jackpot prize value; and storing one of the first jackpot limits as the first mystery jackpot prize pool value ($J_{Current}$); and a second controller to coordinate activation of the plurality of indicators in a predetermined display sequence in response to said determination, thereby indicating the winning side wager betting position.

2. The gaming apparatus of claim 1, further comprising a plurality of gaming tables, each gaming table of the plurality of gaming tables comprising:

a. a second sensor apparatus to:

i. detect the presence of gaming chips at a side wager betting position; and ii. generate, in response to that detection, a signal identifying the side wager betting position and a side wager value; and b. a second plurality of indicators for displaying auxiliary game related data related to a side wager betting position, wherein the game computer is in communication with the second sensor apparatus of each of the plurality of gaming tables and with the second plurality of indicators of each of the plurality of gaming tables.

3. The gaming apparatus of claim 1, wherein the controller is operable to indicate the winning side wager betting position by:

providing an initial display sequence of coordinated activation of the indicators; and providing a final display sequence whereby the indicator of the winning side wager betting position of the first game is distinguishable from other indicators.

4. The gaming apparatus of claim 1, wherein the indicator visually displays a pattern corresponding to the amount of a side wager detected at the side wager betting position.

5. The gaming apparatus of claim 1, wherein the predetermined display sequence includes one of sparkling, pulsing, spinning, and flashing.

6. The gaming apparatus of claim 1, further comprising:

a display unit interconnected to the game computer, visually discernible from the gaming table and to indicate a magnitude of payout for the first auxiliary game.

7. A gaming apparatus, comprising:

a gaming table comprising:

a. a first table area on which a table game is played;

b. a second table area comprising a number of side wager betting positions;

c. a sensor apparatus to:

i. detect the presence of gaming chips at a side wager betting position; and ii. generate, in response to that detection, a signal identifying the side wager betting position and a side wager value; and d. a plurality of indicators to display auxiliary game related data related to respective side wager betting positions;

a game computer in communication with the sensor apparatus and the plurality of indicators, the game computer comprising:

a first controller to compile a game log to correlate, for each side wager betting position wherein a side wager has been detected, the side wager betting position and the value of the side wager detected;

a memory device to store:

said game log;

a first mystery jackpot range between a first lower jackpot limit ($J_{Lower}$) and a first upper jackpot limit ($J_{Upper}$);

a side wager value ($W_{Entry}$) for participating in the auxiliary game;

a first mystery jackpot contribution portion ($W_{Contrib}$) of the side wager value ($W_{Entry}$) to accumulate the first mystery jackpot prize pool; and a first mystery jackpot prize pool value ($J_{Current}$) representing the accumulated mystery progressive jackpot prize pool;

a random number generator to generate random number data;

a processor to determine a winning side wager betting position of the first auxiliary game from among participating side wager betting positions on the basis of generated random number data;

wherein the processor is operable to select a winner of the first game by consecutively processing each side wager placed at a side wager betting position by:

determining the probability that the respective side wager betting position will be a winner in view of the first mystery jackpot prize pool value ($J_{Current}$), the first mystery jackpot contribution portion ($W_{Contrib}$) of the side wager value ($W_{Entry}$), and the first jackpot limits ($J_{Lower}$ and $J_{Upper}$);

generating and storing a random number representing a first random probability;

calculating a new first mystery jackpot prize pool by incrementing the stored first mystery jackpot prize pool value ($J_{Current}$) by the first mystery jackpot contribution portion ($W_{Contrib}$);

storing the new first jackpot prize pool value as the first mystery jackpot prize pool value ($J_{Current}$);

wherein when a first random probability is less than the probability that the respective side wager betting position will be a winner:

nominating the side wager betting position associated with the last-processed side wager as a winner of the first game;

saving the first mystery jackpot prize pool value ($J_{Current}$) as the first mystery jackpot prize value; and storing one of the first jackpot limits as the first mystery jackpot prize pool value ($J_{Current}$).

8. The gaming apparatus of claim 7, wherein the controller is operable to indicate the winning side wager betting position by:

providing an initial display sequence of coordinated activation of the indicators; and providing a final display sequence whereby the indicator of the winning side wager betting position of the first game is distinguishable from other indicators.

9. The gaming apparatus of claim 7, wherein the indicator visually displays a pattern corresponding to the amount of a side wager detected at the side wager betting position.

10. The gaming apparatus of claim 7, wherein the predetermined display sequence includes one of sparkling, pulsing, spinning, and flashing.

11. The gaming apparatus of claim 7, further comprising:

a display unit interconnected to the game computer, visually discernible from the gaming table and to indicate a magnitude of payout for the first auxiliary game.

12. A gaming apparatus, comprising:

a gaming table comprising:

a plurality of player positions each to accommodate a respective base game player and wherein each player position comprises a respective player's console having:

a plurality of indicators to display auxiliary game related data; and a side wager registration device to sense whether a side wager has been registered at a respective player's console by sensing the presence of a gaming chip at the side wager registration device, to generate, when a chip is sensed, a confirmation signal indicative that a respective player is a participating player in the auxiliary game, and to register and record a value of the side wager; and a dealer's position to accommodate the dealer, the dealer's position having a dealer's console; and a game computer comprising:

a random number generator to generate random number data as a basis for determination of a winner of a first mystery progressive jackpot game among participating players, the determination unrelated to the base game; and a controller to coordinate activation of the plurality of indicators in a predetermined display sequence to notify the players of the winner, and to compile a table game log of which players have made a side wager indexed by their location at the gaming table;

memory to record data indicative of predetermined first mystery progressive jackpot parameters, the parameters comprising:

a first mystery jackpot range between a first lower jackpot limit (JLower) and a first upper jackpot limit (JUpper);

a current mystery progressive jackpot prize pool value (JCurrent);

a side wager value (WEntry) for participating in the auxiliary game; and a first mystery jackpot contribution portion (WContrib) of the side wager value (WEntry) to accumulate the first mystery jackpot prize pool (JCurrent) within the first mystery jackpot range;

and wherein the game computer comprises a second mystery progressive jackpot game and memory to record data indicative of predetermined second mystery progressive jackpot parameters, comprising:

a second mystery jackpot range between a second lower jackpot limit ($J_{Lower}$) and a second upper jackpot limit ($J_{Upper}$);

a current second mystery progressive jackpot prize pool value ($J_{Current}$);

a side wager value ($W_{Entry}$) for participating in the auxiliary game; and a second mystery jackpot contribution portion ($W_{Contrib}$) of the side wager value ($W_{Entry}$) to accumulate the second mystery jackpot prize pool ($J_{Current}$) within the second mystery jackpot range.

13. The gaming apparatus of claim 12, wherein each wager registration device comprises a receiving location to receive a betting chip and a sensor to sense the presence of a betting chip at the receiving location.

14. The gaming apparatus of claim 13, wherein each betting chip is visually identifiable as corresponding to a predetermined betting value.

15. The gaming apparatus of claim 12, wherein an indicator of the plurality of indicators includes a visual display screen.

16. The gaming apparatus of claim 12, wherein an upper surface of an indicator of the plurality of indicators forms the receiving location of a respective player's side wager registration device.

17. The gaming apparatus of claim 12, wherein the game computer comprises an event progressive jackpot game and memory to record data indicative of predetermined event progressive jackpot parameters.

* * * * *